United States Patent [19]

Kauffman et al.

[11] 4,346,819

[45] Aug. 31, 1982

[54] CARTON FILLER AND VOLUME ADJUSTER APPARATUS FOR PACKAGING MACHINES

[75] Inventors: Ivan L. Kauffman, Commerce Township, Oakland County; Gregory J. Dwyer, Livonia, both of Mich.

[73] Assignee: Ex-Cell-O Corporation, Troy, Mich.

[21] Appl. No.: 89,056

[22] Filed: Oct. 29, 1979

[51] Int. Cl.[3] ..... G01F 11/02

[52] U.S. Cl. ..... 222/41; 222/309; 74/10.7; 74/53; 74/828

[58] Field of Search ..... 141/152, 266; 74/828, 74/10.7, 89.22; 222/41, 309

[56] References Cited

U.S. PATENT DOCUMENTS 2,640,425 6/1953 Saalfrank ..... 74/828

FOREIGN PATENT DOCUMENTS 45817 5/1939 Netherlands ..... 74/828

*Primary Examiner*—Robert J. Spar
*Assistant Examiner*—Frederick R. Handren
*Attorney, Agent, or Firm*—John P. Moran

[57] ABSTRACT

This invention relates to the carton container packaging art, and to a carton filler drive unit and volume adjuster apparatus for packaging machines which have a plurality of filler apparatuses disposed in a linear arrangement, for filling a plurality of cartons at individual fill stations which are disposed in a linear arrangement.

The filler drive unit includes a plurality of filler operating shafts which are adapted to be moved between a lowered and raised position by an adjustable cam linkage structure which is powered by the packaging machine main drive shaft. A volume adjuster means is provided for adjusting the stroke of the filler operating shafts to provide very precise calibration of the volume of product being dispensed by the individual carton filler apparatuses controlled by the filler drive unit of the present invention.

14 Claims, 16 Drawing Figures

CARTON FILLER AND VOLUME ADJUSTER APPARATUS FOR PACKAGING MACHINES

TECHNICAL FIELD

This invention relates generally to the packaging machine art, and more particularly to a carton filler drive and volume adjuster apparatus for packaging machines. The invention is specifically concerned with a filler drive unit and volume adjuster for operating carton filler apparatuses disposed in a linear arrangement.

BACKGROUND ART

It is known in the packaging machine art to provide filler drive and volume adjuster apparatuses for use with carton filler mechanisms. A disadvantage of the prior art filler drive and volume adjuster apparatuses is that they cannot be used for adjusting both for a fine volume adjustment and for large volume adjustments, and for adjusting between different sizes of cartons. A further disadvantage of the prior art carton filler drive and volume adjuster apparatuses is that they cannot precisely calibrate the volume of product being filled in a carton. Examples of prior art carton filler apparatuses and filler drive structures are disclosed in U.S. Pat. No. 2,356,420.

DISCLOSURE OF THE INVENTION

This invention relates to the carton container packaging art, and to a carton filler drive unit and volume adjuster apparatus for packaging machines which have a plurality of filler apparatuses disposed in a linear arrangement, for filling a plurality of cartons at individual fill stations which are disposed in a linear arrangement.

A filler drive unit including a plurality of filler operating shafts which are adapted to be moved simultaneously between a lowered and a raised position by an adjustable cam linkage structure which is powered by the packaging machine main drive shaft. A volume adjuster means is provided for adjusting the stroke of the filler operating shafts to provide very precise calibration of the volume of product being dispensed by the individual carton filler apparatuses controlled by the filler drive unit of the present invention.

The filler drive unit structure includes a rotatable eccentric cam which is rotated by the packaging machine main drive shaft. A first cam follower link is provided which has one end pivotally mounted to a fixed structure on the machine, and the other end pivotally mounted to one end of a cam link. The other end of the cam link is slidably supported by means of a roller in a slot on an adjustable block. A second cam link is provided which has one end fixed to a pivotally mounted roller carrier plate, and the other end provided with a cam follower slot for the reception of a cam carried by the cam link. The pivotally mounted roller carrier arm has a plurality of rollers disposed in vertically aligned positions with the filler operating shafts whereby when the first named cam is rotated, it pivots the first cam follower link in one direction and a return spring moves it in the other direction in an oscillating manner. The cam link and the second cam follower link are also oscillated by the action of the first named cam and return spring whereby the pivotally mounted roller carrier plate is moved upwardly and downwardly to move the plurality of rollers upwardly and downwardly and operate the filler operating shafts. The position of the adjustable block is adjustable by a volume adjustment means which includes an indicator means comprising a calibrated scale and a movable pointer.

BEST MODE OF CARRYING OUT THE INVENTION

Figure 1:
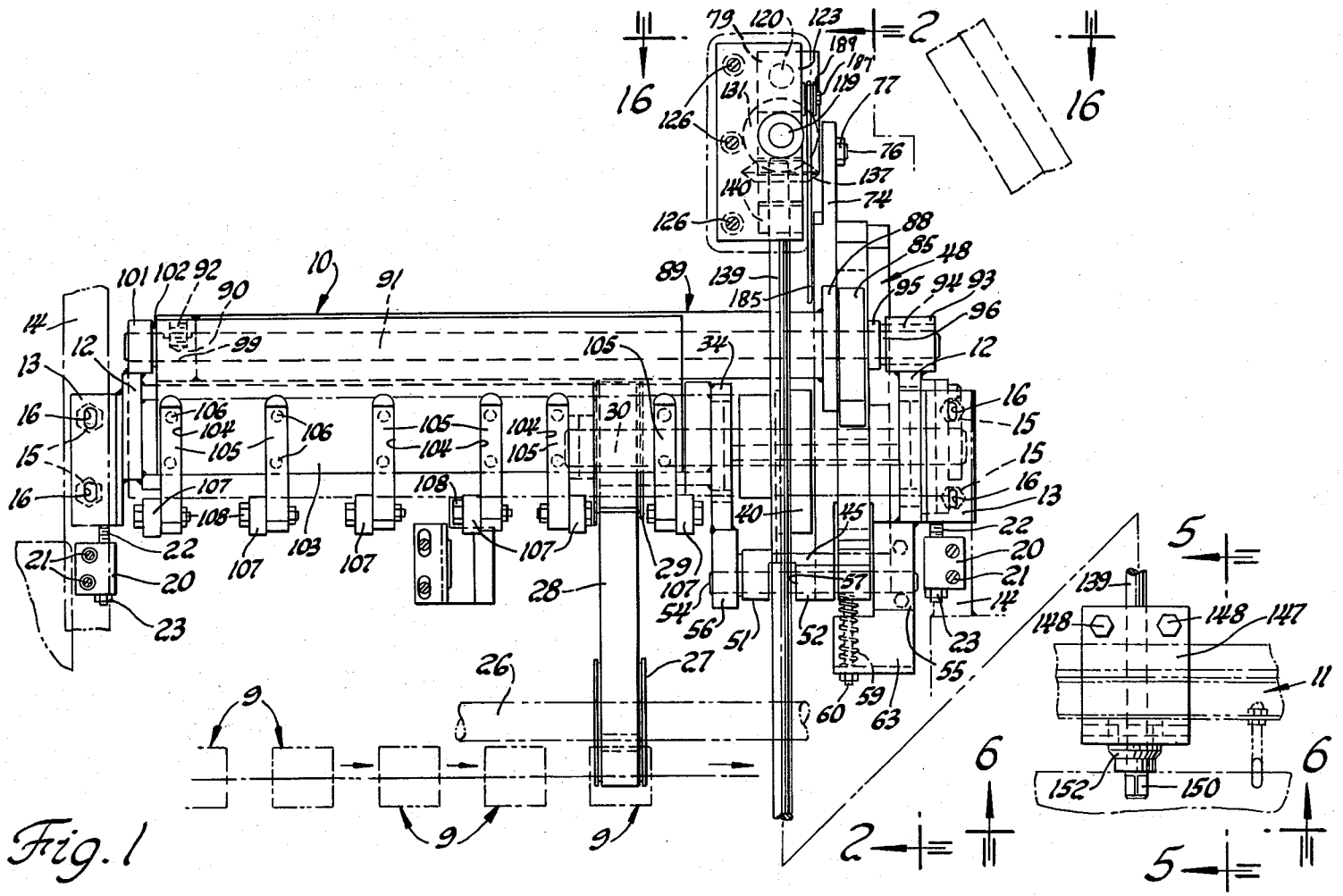
FIG. 1 is a top plan view of a carton drive unit and volume adjuster apparatus made in accordance with the principles of the present invention.

Referring now to the drawings, and in particular to FIG. 1, the numeral 9 generally designates the carton fill stations on a conventional packaging machine. The number of fill stations 9 varies on such packaging machines in accordance with the size of the cartons being filled. That is, some machines may have four fill stations, while others may have six and so forth.

Figure 3:
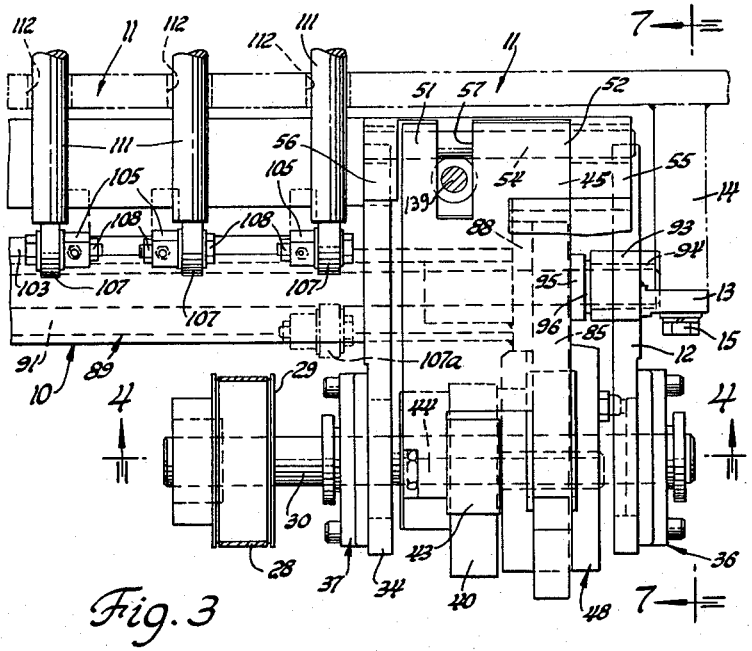
FIG. 3 is a left side elevation view of the structure illustrated in FIG. 2, with parts in section and parts removed, taken substantially along the line 3—3 thereof, and looking in the direction of the arrows.

The numeral 10 generally designates the carton filler drive unit and volume adjuster apparatus of the present invention which is disposed in an appropriate position in a packaging machine under the filler apparatus for operating the same. As shown in FIG. 3, the numeral 11 designates the usual packaging machine base plate, on the top of which is usually mounted a conventional straight line carton filler apparatus. As shown in FIG. 1, the carton filler drive unit and volume adjuster apparatus 10 is provided with a horizontal mounting plate 13 at each end thereof. Each of the mounting plates 13 is attached by any suitable means, as by welding, to two vertical frame end plates 12. Each of the mounting plates 13 is provided with a pair of elongated slots 16, as shown in FIG. 1. As illustrated in FIG. 3, each of the mounting plates 13 is secured by suitable machine screws 15 to the lower side of a packaging machine support wall 14, which is fixedly secured to the underside of the packaging machine base plate 11 by any suitable means, as by welding. The elongated slots 16 permit the filler drive unit and volume adjuster apparatus 10 to be adjusted by means of the adjustment set screws 22 (FIG. 1) to a proper position to set the belt tension of the drive belt 28 and align the filler drive shaft 30 with the packaging machine drive shaft 26.

The adjustment set screws 22 are each threadably mounted through a suitable adjustment screw mounting block 20 (FIG. 1), with one end of the adjustment screws abutting the adjacent end of one of the mounting plates 13. Each of the adjustment screw mounting blocks 20 is fixedly secured to the underside of the packaging machine base plate 11 by any suitable means, as by a pair of suitable socket cap screws 21. Each of the set screws 22 is secured in an adjusted position in its respective mounting block 20 by a suitable jam nut 23.

Figure 4:
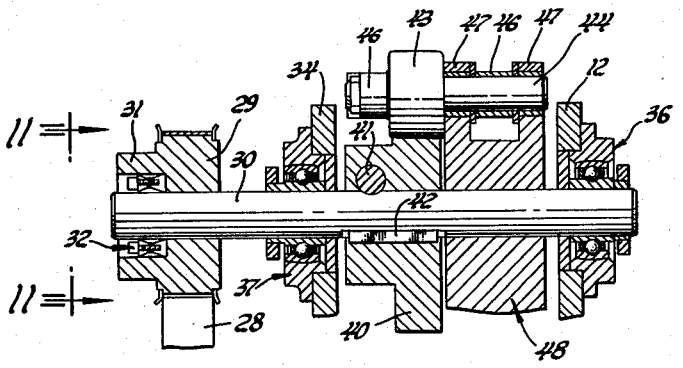
FIG. 4 is a fragmentary, horizontal section view of the structure illustrated in FIG. 3, taken along the line 4—4 thereof, and looking in the direction of the arrows.

As shown in FIG. 1, the numeral 26 designates the usual packaging machine main drive shaft which provides the power for driving and operating the various units of a packaging machine, such as the carton conveyor apparatus, the carton bottom tucker-tacker assembly, and so forth. The packaging machine main drive shaft 26 is provided with a drive gear belt pulley 27, around which is operatively mounted a gear belt 28. The gear belt 28 is also operatively mounted around a driven gear belt pulley 29 which is fixedly mounted on a filler unit drive shaft 30. As shown in FIG. 4, the driven gear belt pulley 29 is provided with a hub 31 which houses a conventional "RINGFEDER" (a trademark) locking assembly, which is generally indicated by the numeral 32, and which locks the drive gear belt pulley 27 to the filler unit drive shaft 30.

Figure 7:
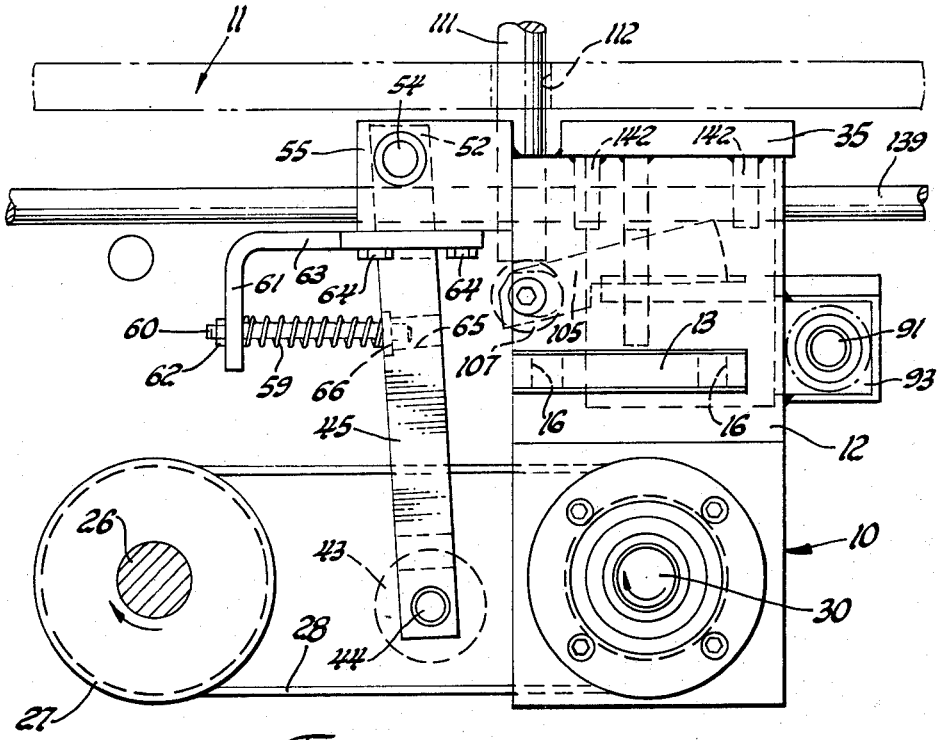
FIG. 7 is a fragmentary, right side elevation view of the structure illustrated in FIG. 3, with parts removed, taken along the line 7—7 thereof, and looking in the direction of the arrows.

As illustrated in FIGS. 3 and 4, the filler unit drive shaft 30 is rotatably mounted in a pair of suitable bearing means, generally indicated by the numerals 36 and 37, which are operatively supported in the vertical frame plates 12 and 34. As illustrated in FIG. 7, the upper end of the vertical frame plate 12 is fixedly secured to one end of a horizontal frame plate 35 by any suitable means, as by welding. The horizontal frame plate 35 extends inwardly and is also welded to the top end of the vertical frame plate 34.

Figure 13:
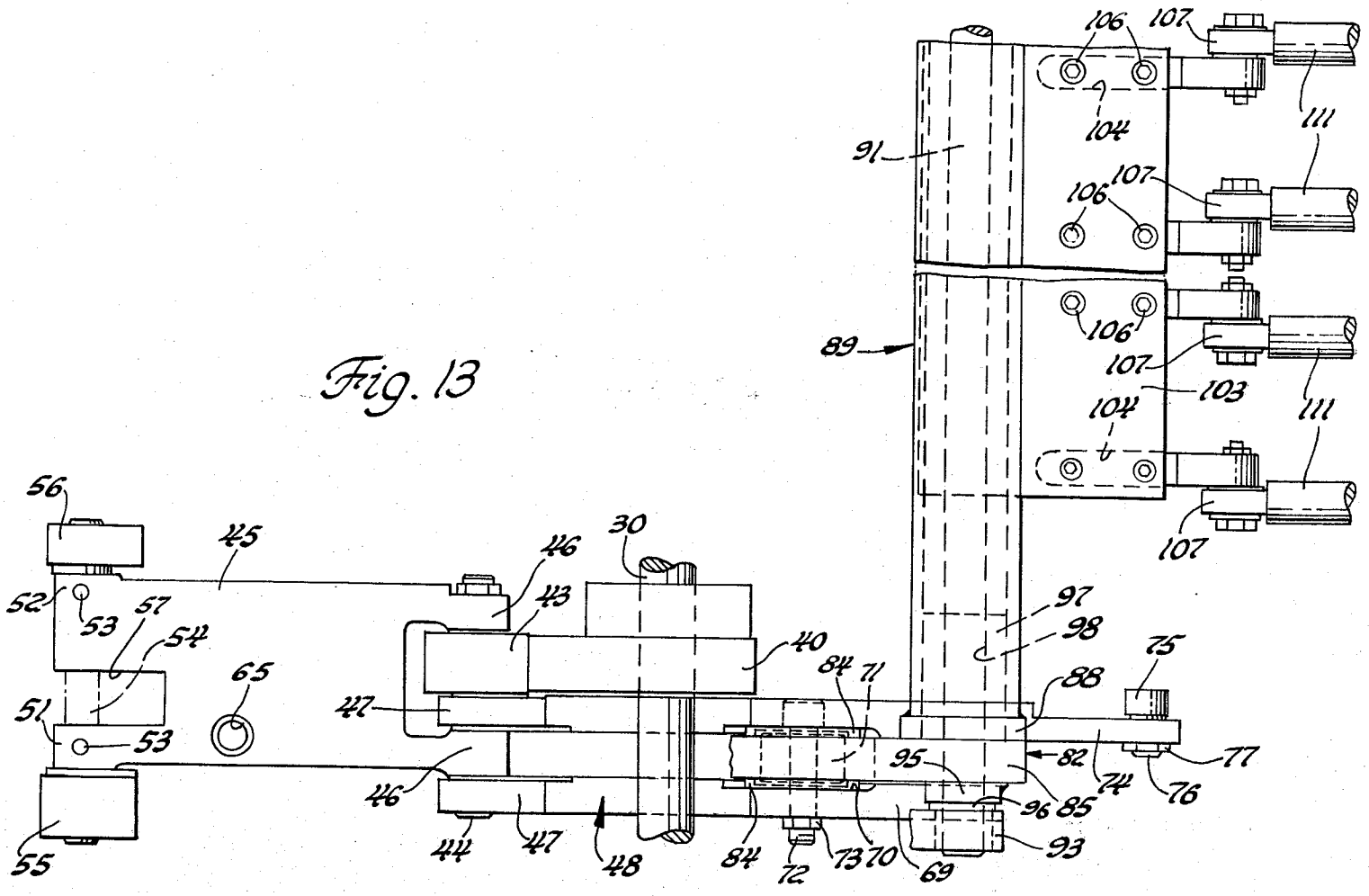
FIG. 13 is a fold-out view of the linkage structure illustrated in FIG. 2, taken substantially along the line 13—13 thereof, and looking in the direction of the arrows.

As shown in FIGS. 3 and 4, the cam 40 is operatively carried on the shaft 30 in a position between the bearing means 36 and 37. The cam 40 is secured to the shaft 30 by a conventional spindle lock 41 and a key 42. As shown in FIGS. 4 and 13, the cam 40 is operatively engaged at its periphery with the periphery of a roller cam follower 43 which is operatively carried on a cam follower carrier link 45. The cam 40 is adapted to move the cam follower 43 between an advanced position, shown in solid lines in FIG. 3, and a retracted position shown by broken lines in FIG. 2 and indicated by the numeral 43*a*.

As shown in FIGS. 4 and 13, the lower end of the cam follower carrier link 45 is provided with a pair of laterally spaced mounting journals 46 which rotatably support a suitable transverse cam follower carrier shaft 44. The cam follower 43 is rotatably supported on a suitable bearing means on the shaft 44, in a position adjacent the one journal 46. A cam follower link, generally indicated by the numeral 48, is provided with a pair of spaced apart mounting journal members 47, and they are also rotatably mounted by suitable bearings on the shaft 44, with one of the journal members 47 being disposed between the cam follower 43 and one of the link mounting journals 46, and the other journal member 47 being located on the outboard side of the last mentioned link mounting journal 46. The numeral 48*a* shows the cam follower link 48 in a retracted position, and the solid line position of link 48 in FIG. 2 shows the link 48 in an advanced position.

As shown in FIG. 13, the cam follower carrier link 45 is provided on the upper end thereof with a pair of laterally spaced apart mounting journal members 51 and 52, through which is operatively mounted a transverse pivot shaft 54. The pivot shaft 54 is fixedly secured, as by suitable set screws 53, to the mounting journal members 51 and 52. The ends of the pivot shaft 54 are rotatably mounted in suitable bearing means carried in a pair of laterally spaced apart mounting blocks 55 and 56. As shown in FIG. 7, the mounting block 55 is fixedly secured, as by welding, to the outer vertical frame plate 12. As shown in FIG. 1, the mounting block 56 is fixedly secured, as by welding, to the inner vertical frame plate 34. The link 45 is provided with a slot 57 between the mounting journal members 51 and 52 for the passage therethrough of a calibrator adjusting shaft 139, as shown in FIGS. 2 and 3.

Figure 2:
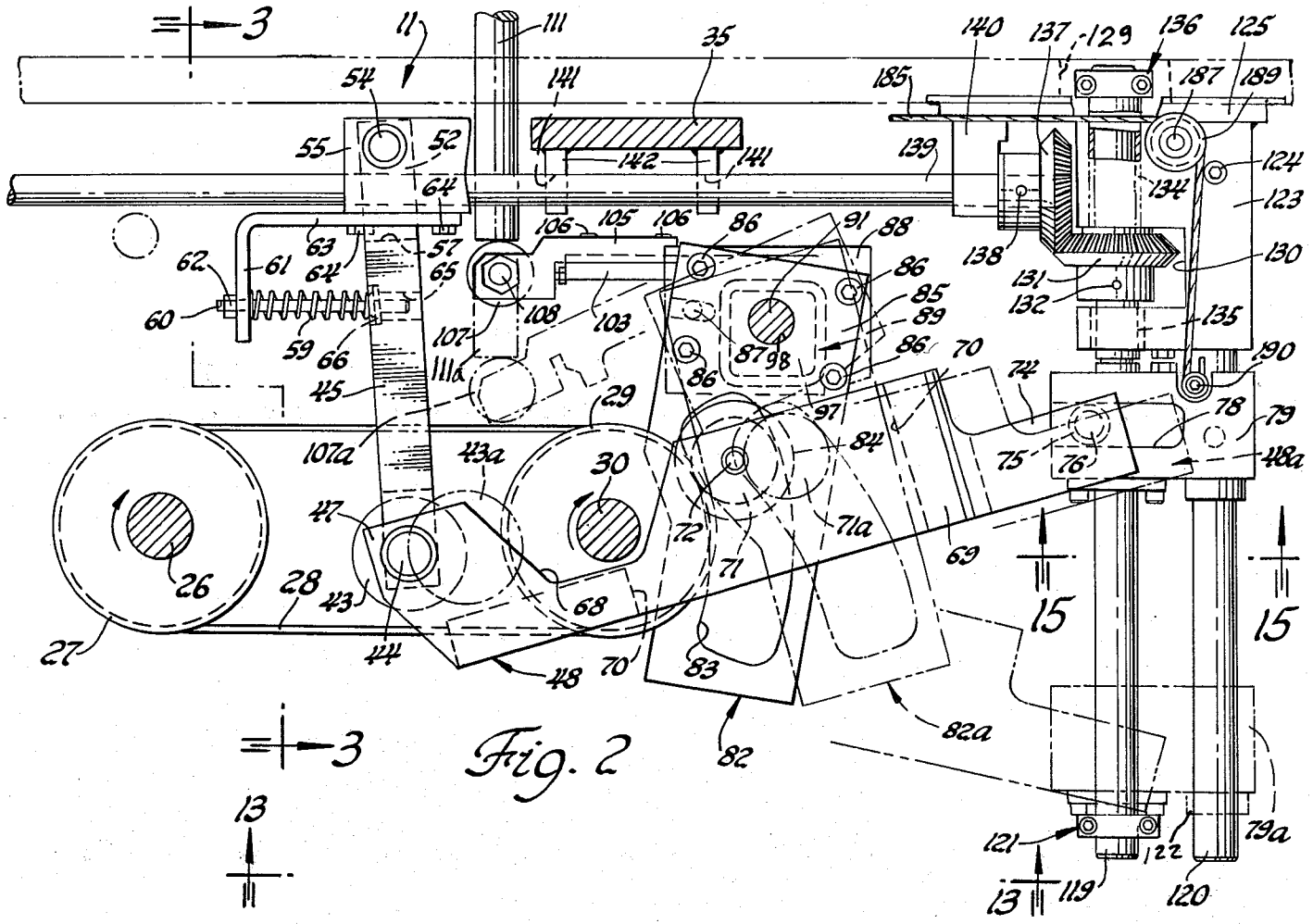
FIG. 2 is a fragmentary, right side elevation view of the structure illustrated in FIG. 1, with parts removed, taken substantially along the line 2—2 thereof, and looking in the direction of the arrows.

As illustrated in FIG. 2, the link 45 is moved to the right to a retracted position 43*a* by a return spring 59. The solid line position of the link 45 in FIG. 2 shows an advanced position. The return spring 59 is operatively mounted around a spring guide shaft 60 which has the outer end abutting the inner face of a vertical bracket flange 61. The outer end of the shaft 60 is threadably mounted through a suitable bore in the bracket flange 61, and it is fixed in an adjusted position by a suitable lock nut 62. The upper end of the bracket flange 61 is integrally attached to a horizontal bracket flange 63 which is fixedly secured by any suitable means, as by suitable machine screws 64, to the lower side of the mounting block 55. The inner end of the spring guide shaft 60 extends into a stepped bore 65 formed in the link 45. The inner end of the spring 59 seats against a suitable washer means 66 seated in the enlarged end of the bore 65.

Figure 16:
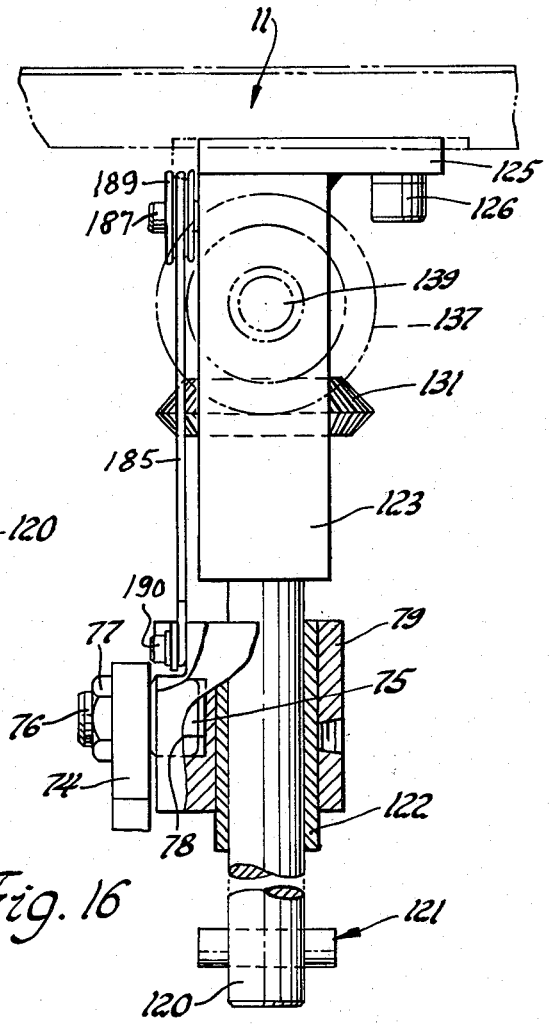
FIG. 16 is a fragmentary, enlarged, broken, partly in section, elevation view of the structure illustrated in FIG. 1, taken along the line 16—16 thereof, and looking in the direction of the arrows.

As shown in FIG. 2, the link member 48 is provided with a recess 68 for passage therethrough of the drive shaft 30. As shown in FIG. 2, a slot 70 is formed through a link body 69. As shown in FIGS. 2 and 13, a roller arm cam 71 is rollably mounted in the slot 70 on a transverse shaft 72 which is operatively mounted in the link body 69 and secured in place by a suitable lock nut 73 (FIG. 13). As shown in FIGS. 2 and 13, the link 48 has an integral link extension arm 74, on the outer end of which is rollably mounted a roller cam follower 75. The cam follower 75 is rollably mounted on the link extension arm 74 by a suitable shaft 76 which is fixed in position by a suitable lock nut 77. As shown in FIGS. 2 and 16, the roller cam follower 75 is rollably mounted in a cam track 78 which is formed in a block 79. The numeral 79*a* in FIG. 2 designates the position of the block 79 when the drive unit is moved to the machine set-up position. As shown in FIG. 13, a spacer 84 is mounted on each side of the roller cam 71 in the slot 70 in the link 48.

As shown in FIGS. 2 and 13, a cam link, generally indicated by the numeral 82, has the upper end 85 fixedly secured, by suitable machine screws 86 and a dowel key 87, to a retainer plate 88. The cam link 82 is provided with an arcuate cam track 83 in which is rollably received the roller cam 71. The numeral 82*a* indicates the position of the cam link 82 when it is in the retracted position.

As shown in FIG. 1, the retainer plate 88 is fixedly secured, as by welding, to the right end of an elongated tubular pivot shaft, generally indicated by the numeral 89. As shown in FIG. 1, the left end of the tubular pivot shaft 89 has fixedly mounted therein, as by welding, a retainer block 90. The retainer block 90 has a bore 99 formed therethrough in which is mounted one end of an elongated pivot shaft 91. The pivot shaft 91 is secured to the retainer block 90 by a suitable set screw 92.

The pivot shaft 91 extends through the tubular pivot shaft 89, and the right end thereof is extended through a bore 98 formed through a right end retainer block 97 (FIG. 13). The retainer block 97 is retained in the right end of the tubular pivot shaft 89 by any suitable means, as by welding. As shown in FIG. 13, the pivot shaft 91 extends through the retainer plate 88, and the upper end 85 of link 82, and through a spacer member 95, and into a suitable bearing in a pivot journal 93. As shown in FIG. 7, the pivot journal 93 is fixedly secured, as by welding, to the one vertical side of the vertical frame plate 12. As shown in FIG. 13, the spacer 95 is fixed, as by welding, to the outer face of the upper end 85 of the cam link 82, and it is spaced from the pivot journal 93 by a suitable washer 96.

As shown in FIG. 1, the left end of the pivot shaft 91 is extended out beyond the left end of the tubular pivot shaft 89, and it is rotatably mounted in suitable bushings and a pivot journal 101. The pivot journal 101 is spaced from the left end of the tubular pivot shaft 89 by a suitable washer 102. The pivot journal 101 is fixedly secured by any suitable means, as by welding, to the left end vertical member 12.

As shown in FIGS. 3 and 13, a longitudinally extended carrier arm, in the form of a plate 103, is fixed, as by welding, to the tubular pivot shaft 89. As shown in FIG. 1, the carrier arm 103 is provided with a plurality of longitudinally spaced apart transverse bar slots 104, in each of which is adjustably mounted a roller carrier bar 105, by means of a pair of suitable machine screws 106. Rollably mounted on the outer end of each of the carrier bars 105 is a roller 107. Each of the rollers 107 is rollably attached to its respective carrier bar 105 by a suitable shaft and bearing means 108. The numeral 107*a* in FIG. 3 shows the lowered position of the rollers 107, while the solid line position of these rollers shows the raised position.

As shown in FIG. 3, each of the rollers 107 is adapted to operatively engage the lower end of a vertically disposed filler operating shaft. The filler operating shafts 111 are each adapted to extend upwardly through a suitable bore 112 in the machine base plate 11. Each of the filler operating shafts 111 is adapted to operate a carton filler apparatus disposed at one of the respective fill stations 9. The filler operating shafts 111 are adapted to operate conventional filler apparatuses, as for example, the filler apparatus shown in U.S. Pat. No. 2,356,420, the details of which are of no concern to the invention disclosed in this application.

Figure 14:
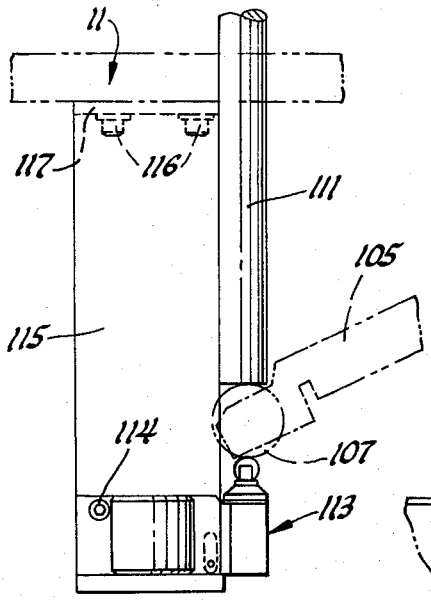
FIG. 14 is an illustrative view showing the filler drive roller means in a clean in place (C.I.P.) position.

As shown in FIG. 2, each of the filler operating shafts is moved by the drive apparatus of the present invention between a raised position shown in solid lines in FIG. 2, and a lowered position shown in broken lines and indicated by the numeral 111*a*. FIG. 14 shows the position of a filler operating shaft when the filler drive apparatus of the present invention is adjusted to move the filler operating shaft 111 to a clean-in-place position (C.I.P.) Numeral 113 designates a limit switch which would be positioned in each of the rollers 107, at the last mentioned position, for control purposes. The limit switch 113 is attached by suitable machine screws 114 to a suitable bracket 115 which has a flange 117 that is secured to the underside of the packaging machine base plate 11.

Figure 15:
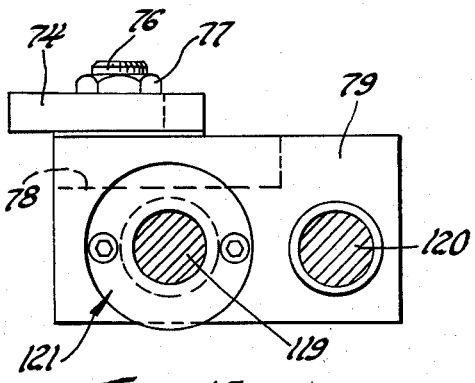
FIG. 15 is a fragmentary, horizontal cross section view of the structure illustrated in FIG. 2, taken along the line 15—15 thereof, and looking in the direction of the arrows.

As shown in FIGS. 1, 2 and 15, the block 79 is movably supported on a screw shaft 119 and a guide shaft 120. The screw shaft 119 actuates the block 79 upwardly and downwardly on the guide shaft 120. As shown in FIG. 2, the retracted or lowermost position of the block 79 is shown in broken lines, and it is indicated by the numeral 79*a*. The lowermost position of the block 79 is limited by a stop collar, generally indicated by the numeral 121. As shown in FIG. 16, a suitable bushing 122 is operatively mounted in the block 79 for slidably mounting the block 79 on the guide shaft 120. As shown in FIGS. 2 and 16, the screw shaft 119 and the guide shaft 120 have their upper ends operatively mounted in a mounting block 123 which is fixedly secured, as by welding, to the lower side of a mounting plate 125. As shown in FIG. 16, the mounting plate 125 is fixedly secured to the lower side of the base plate 11 by suitable machine screws 126. The upper end of the guide shaft 120 is slidably mounted in a suitable bore in the mounting block 123, and it is secured in place by a suitable set screw 124.

As shown in FIG. 2, the mounting block 123 is provided with an inwardly extended recess 130 in which is positioned a bevel driven gear 131. The bevel gear 131 is fixedly secured by a suitable set screw 132 to the screw shaft unthreaded portion that extends through the recess 130. The upper end of the screw shaft 119 is unthreaded and it is rotatably supported in a suitable bushing 134 carried in the mounting block 123. The unthreaded portion of the screw shaft 119 which is below the bevel gear 131 is also rotatably supported in a suitable bushing 135 which is operatively mounted in the lower end of the block 123.

The upper end of the screw shaft 119 extends upwardly into a bore 129 in the base plate 11, and it is prevented from moving downwardly by an upper stop collar, generally indicated by the numeral 136. The drive assembly for adjusting the screw shaft 119 further includes a bevel drive gear 137 which is meshably engaged with the driven bevel gear 131, and it is fixedly secured, as by a set screw 138, to the inner end of a calibrator adjuster shaft 139. The inner end of the shaft 139 is rotatably supported in suitable bearings that are carried in a bearing housing block 140 which is fixedly secured, as by welding, to the lower side of the mounting plate 125. As shown in FIG. 2, the calibrator adjuster shaft 139 extends to the left, or to the front of the packaging machine, through bores 144 formed in a pair of vertical support plates 142 that are fixed, as by welding, to the lower side of the horizontal frame plate 35.

Figure 5:
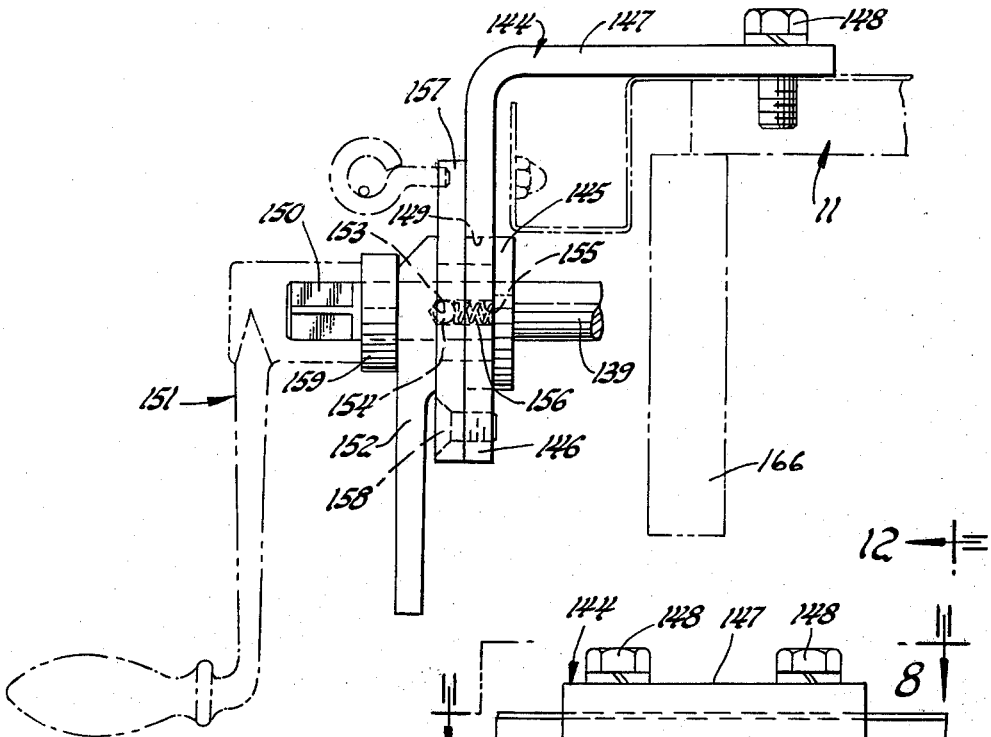
FIG. 5 is a fragmentary, enlarged, elevation view of the structure illustrated in FIG. 1, taken along the line 5—5 thereof, and looking in the direction of the arrows.
Figure 6:
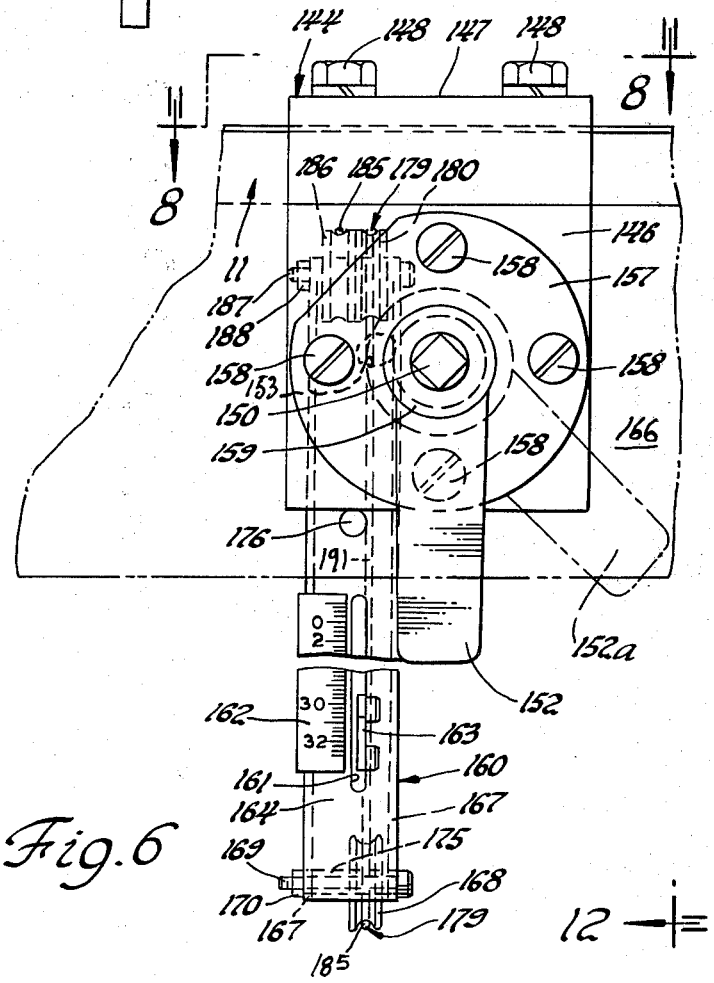
FIG. 6 is a fragmentary, enlarged, broken, front elevation view of the structure illustrated in FIG. 1, taken along the line 6—6 thereof, and looking in the direction of the arrows.

As shown in FIGS. 5 and 6, the front end of the calibrator adjuster shaft 139 is rotatably supported in a suitable bearing housing 145 which is operatively carried by a mounting bracket, generally indicated by the numeral 144. The mounting bracket 144 includes a vertical flange 146 and an integral horizontal bracket flange 147 which is secured by suitable machine screws 148 to the top side of the base plate 11. As best seen in FIG. 5, the shaft bearing housing 145 is operatively supported in a bore 149 formed in the bracket flange 146. The front end of the shaft 139 is formed with a square configuration 150 for the reception of a conventional crank handle, generally indicated by the numeral 151 for adjusting the shaft 139. A hub 157 is secured by a plurality of flat head screws 158 (FIG. 6) to the front side of the bracket flange 146.

As shown in FIGS. 5 and 6, the shaft 139 is provided with a locking means which comprises a collar 159 which is fixedly mounted around the outer end of the shaft 139 by any suitable means, and in a position spaced apart from the hub 157. Rotatably mounted on the shaft 139 between the collar 159 and hub 157 is a lever lock 152. An axial bore 155 is formed through the hub 157 and into the bearing housing 145 from the front end thereof, and in an off-center position, as shown in FIG. 6. As shown in FIG. 5, a detent spring 156 is mounted in the inner end of the bore 155, and a detent ball 154 is mounted in the outer end of the bore 155. The lever lock 152 is provided with a detent ball notch 153 for reception of the ball 154, due to the pressure of the spring 156 when the lever lock is turned to the broken line position 152, which is the unlocked position. When the lever lock 152 is rotated clockwise, as viewed in FIG. 6, to the solid line position, the detent ball is forced out of the detent ball notch 153 on the inner face of the lever lock 152 to create an outward pressure by the lever lock 152 against the collar 159, to lock the shaft 139 in a desired adjusted position.

Figure 8:
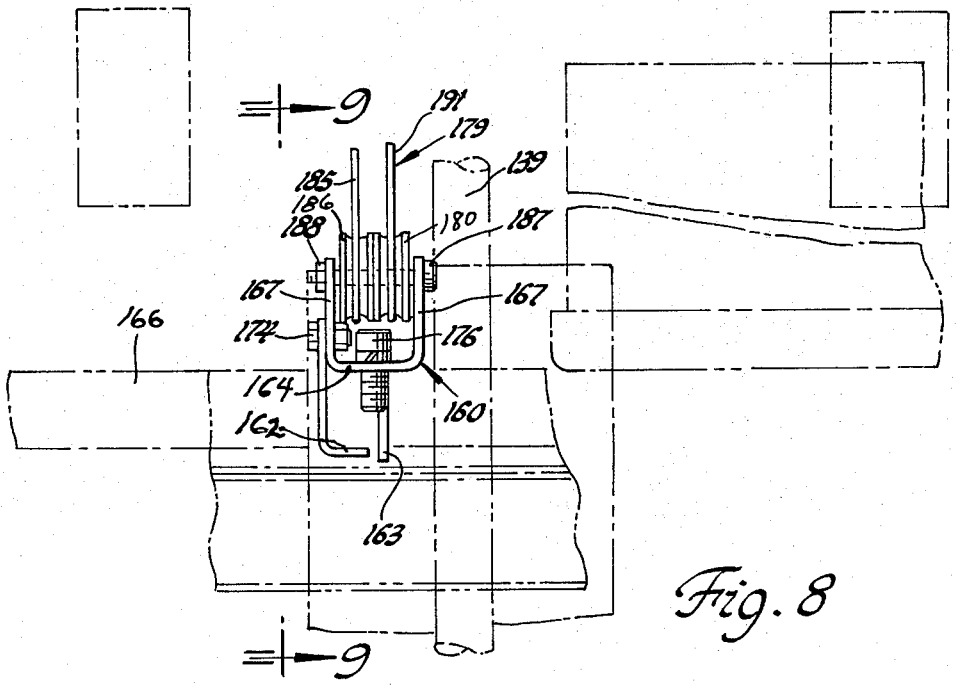
FIG. 8 is a fragmentary, top plan view of the structure illustrated in FIG. 6, taken along the line 8—8 thereof, and looking in the direction of the arrows.
Figure 9:
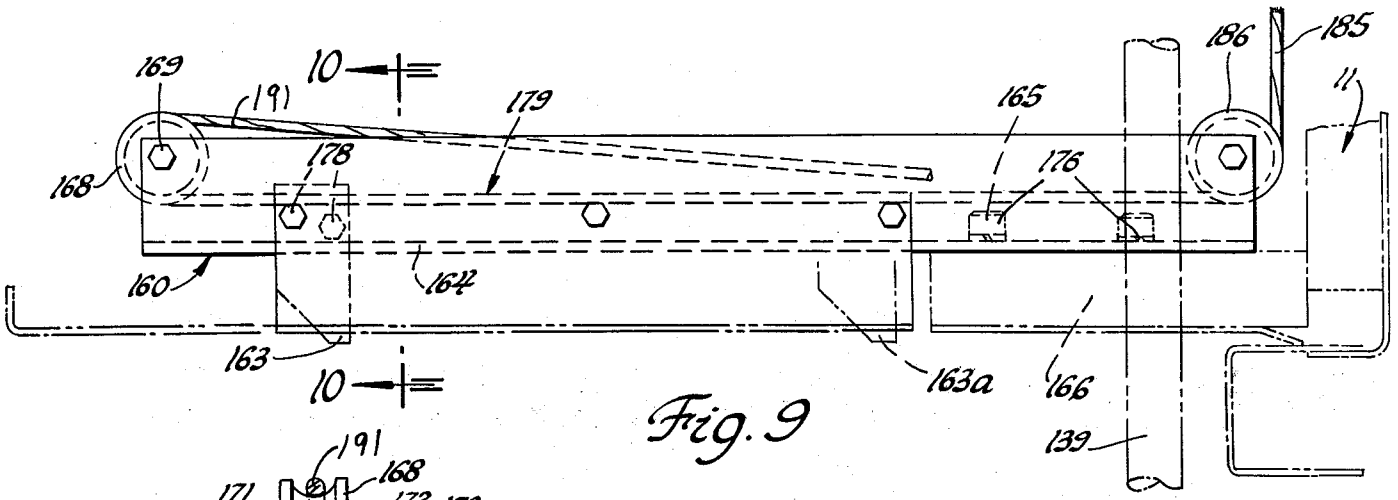
FIG. 9 is a fragmentary, left side elevation view of the structure illustrated in FIG. 8, taken along the line 9—9 thereof, and looking in the direction of the arrows.
Figure 11:
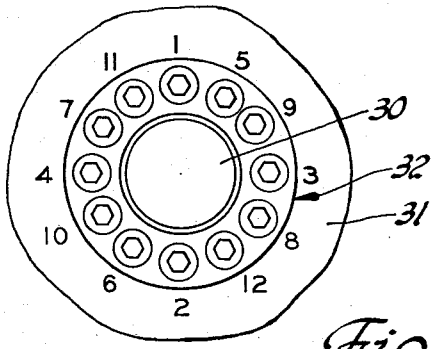
FIG. 11 is a fragmentary,, left end elevation view of the structure illustrated in FIG. 4, taken along the line 11—11 thereof, and looking in the direction of the arrows.
Figure 10:
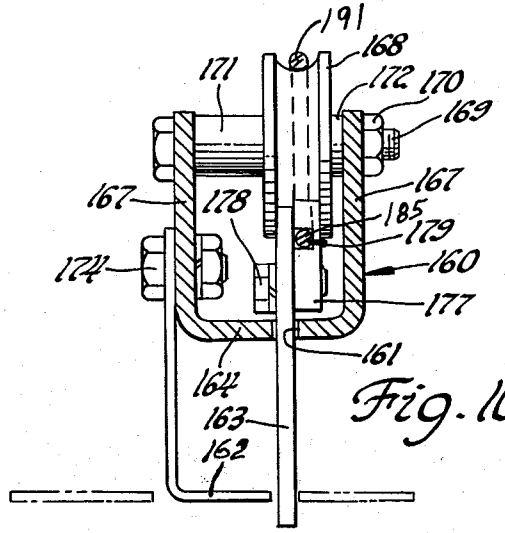
FIG. 10 is a fragmentary, enlarged, horizontal section view of the structure illustrated in FIG. 9, taken along the line 10—10 thereof, and looking in the direction of the arrows.

The adjusting movement of the calibrator adjuster shaft 139 is indicated on the front of the packaging machine by a calibrated scale 162 and a coacting pointer 163 (FIG. 6). The calibrated scale 162 is fixedly mounted (FIG. 10) by any suitable machine screws 174 to one of the side walls 167 of a vertically disposed U-shaped, elongated bracket, generally indicated by the numeral 160. As shown in FIG. 10, the bracket 160 includes a pair of integral, laterally spaced apart side walls 167. As shown in FIGS. 6, 8 and 9, the upper end of the bracket 160 is fixedly secured by suitable machine screws 176 to the inner side of a suitable mounting plate 166, which is part of the packaging machine structure, and which is fixedly secured to the lower side of the base plate 11. As shown in FIGS. 6 and 10, the pointer 163 extends forwardly through a slot 161 formed through the bracket front wall 164.

As shown in FIG. 10, the pointer 163 is fixedly secured by a suitable wire rope clamp 177 to a wire rope, generally indicated by the numeral 179. The clamp 177 is secured to the pointer 163 by suitable machine screws 178.

Figure 12:
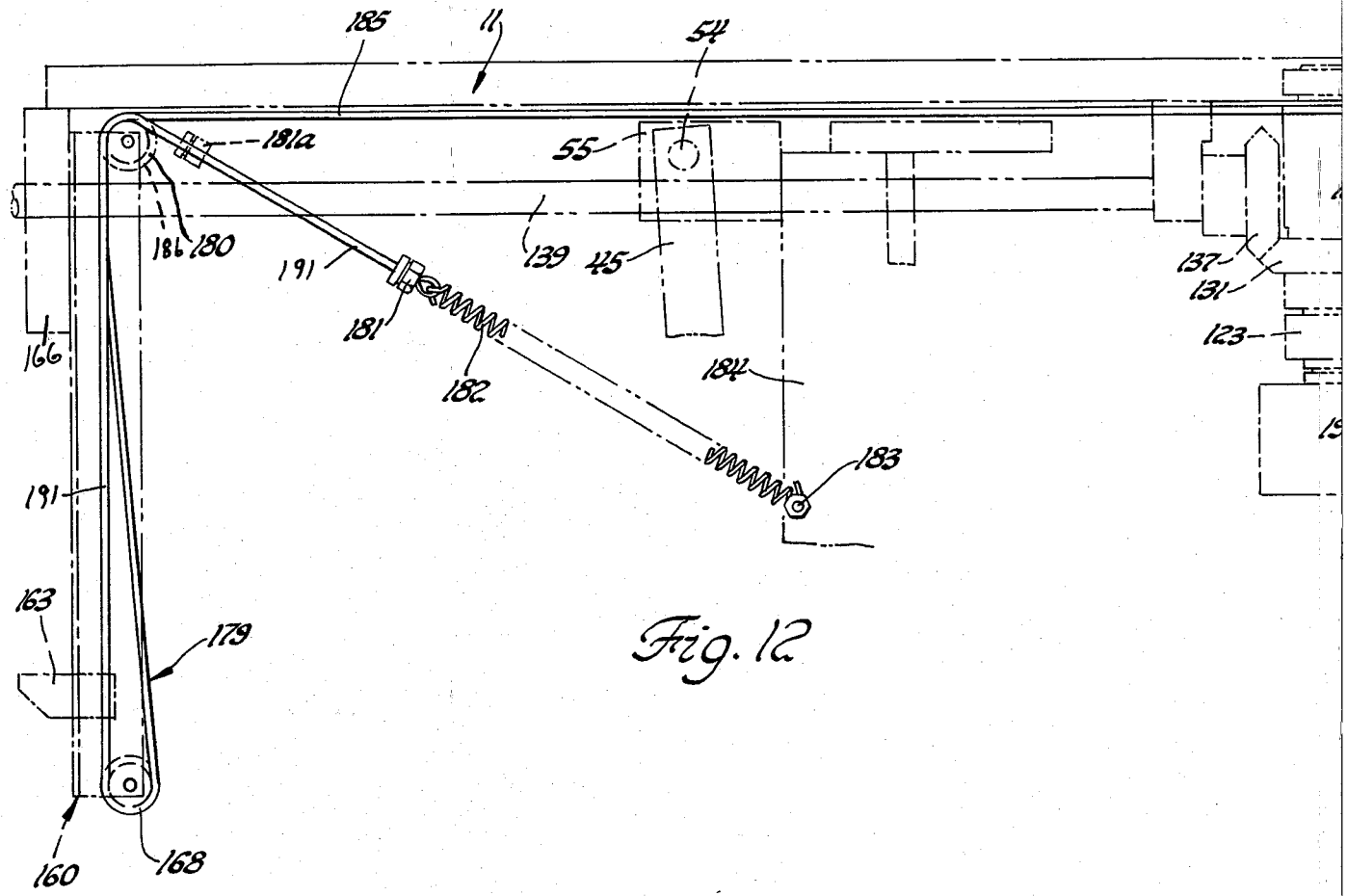
FIG. 12 is a fragmentary, right side elevation view of the structure illustrated in FIG. 6, taken along the line 12—12 thereof, and looking in the direction of the arrows.

As shown in FIGS. 9 and 10, the wire rope 179 has one end 185 mounted around a lower nylon cable pulley 168 which is operatively mounted on the lower end of the bracket 160. The wire rope end 185 is extended upwardly, as shown in FIG. 12, around a nylon cable pulley 186 from whence it is extended to the rear of the packaging machine and over a nylon cable pulley 189. The wire rope end 185 is then extended downwardly and it is attached by a suitable machine screw 190 to the block 79 (FIG. 16). As shown in FIG. 10, the wire rope, nylon cable pulley 168 is rotatably mounted between the bracket side walls 167 by a suitable shaft 169, lock nut 170, the spacer 171, and washer 172.

As shown in FIGS. 6 and 12, the wire rope other end, designated by the numeral 191, extends upwardly and over a nylon cable pulley 180. As shown in FIG. 12, the wire rope end 191 has its free end attached by a suitable wire rope clamp 181 to one end of an extension spring 182. The other end of the extension spring 182 is fixedly secured by a suitable anchor screw means 183 to a machine support wall 184 of the packaging machine.

As shown in FIGS. 6 and 8, the nylon cable pulleys 180 and 186 are operatively mounted between the bracket side walls 167 by a suitable socket head screw 187 and a lock nut 188. As shown in FIG. 12, the nylon cable pulley 189 is also secured to the side of the block 123 by a socket head screw 187. The numeral **181*a* in FIG. 12 indicates an adjusted position of the wire rope clamp 181 when the adjusting shaft 139 is adjusted to move the pointer 163 upwardly when the block 79 is lowered. The numeral 163*a* in FIG. 9 designates a raised position for the pointer 163 corresponding to the position of the wire rope clamp 181*a***.

In use, the filler operating shafts 111 are moved upwardly and downwardly between the raised and lowered positions shown in FIG. 2 by the filler drive apparatus of the present invention when the packaging machine is all set up and running. The packaging machine main drive shaft 26 rotates the drive pulley 27, which in turn drives the driven pulley 29 by means of the belt 28. The pulley 129 rotates the cam shaft 30 in the direction shown by the arrows in FIG. 2. As the cam shaft 30 is rotated, it rotates the eccentric cam 40 which with the return spring 59 oscillates the cam follower 43 between the solid and broken line positions indicated in FIG. 2 by the numerals 43 and **43*a* respectively. The link 45 which carries the cam follower 43 is moved to the left, as viewed in FIG. 2, by the last mentioned camming action, against the return spring 59, during a raising operation of the filler operating shafts 111. At the commencement of the movement of the link 45 to the left against the return spring 59, the rollers 107 are in the position indicated by the numeral 107*a* in FIG. 2. The movement of the link 45 to the left against the return spring 59 also moves the link 48 to the left and the cam follower 75 slides outwardly in the cam slot 78 in block 79. Simultaneously, the roller cam 71 rolls in the cam slot 83 in link 82 to pivot the link 82 to the left as viewed in FIG. 2 from the position 82*a*. The last mentioned action moves the roller carrier arm 103 upwardly from the broken line position shown in FIG. 2, to the upper solid line position. As the eccentric portion of the cam 40 passes over center, the return spring 59 moves the last described linkage back to their solid line positions in FIG. 2 to lower the rollers 107*a* which in turn cause the filler operating shafts 111 to be lowered by gravity and coaction with the carton filler apparatus being operated. It will be understood that the filler apparatus operated by the last described filler drive structure would be set up for certain size cartons, such as half pints, pints, quarts and so forth. It will also be understood that, when a packaging machine is running, the weights of the filled cartons are periodically checked and, if the operator finds that the cartons are being underfilled, then he must make a fine volume adjustment. This is carried out by adjusting the position of the block 79 to change the stroke of the filler operating shafts 111. It will be understood that the shaft 139 may be adjusted while the machine is in operation, and that the calibrated scale 162 and the pointer 163 provide a simple and effective indicator system for adjusting the volume as required to bring the weight of the filled cartons back to the proper volume. The drive unit and volume calibration apparatus of the present invention are adapted for making fine volume adjustments as well as for calibrating for a large volume change, and also for adjusting between different sizes of cartons. It will be seen that as the block 79 is adjusted downwardly, it pulls on the cable end 185 which moves the pointer 163 upwardly and extends the spring 182. The spring 182 provides a make-up cable function, and it maintains a tension on the wire rope 179. The slide pointer or indicator 163 moves upwardly and downwardly in its slot 161 to provide an economical indicator system. The calibrated scale 182** provides a means of informing the machine operator at what point he is in making volume adjustments. The calibrator structure of the present invention is a precise volume calibrator and it provides for good repeatability.

INDUSTRIAL APPLICABILITY

The carton filler and volume adjuster apparatus of the present invention is adapted for use with packaging machines which package liquid products and similar products capable of being loaded into a gable or flat top type carton or container from a flow type filler apparatus as, for example, various dairy products, soft drinks, other flowable food products, and liquid type products such as oils and the like.

We claim:

1. A filler drive and volume adjustment apparatus for use in a packaging machine which forms, fills and closes cartons, characterized in that said apparatus includes:

(a) at least one filler operating shaft for operating a carton filler apparatus on a packaging machine;

(b) a pivotally mounted roller carrier plate;

(c) at least one roller means mounted on said carrier plate and disposed for operative engagement with the lower end of said at least one filler operating shaft for actuating said filler operating shaft between a lowered position and a raised position;

(d) a first cam follower link operatively attached to said roller carrier plate for pivoting said carrier plate between operative positions;

(e) a cam carrier link having a roller cam operatively engaged with said first cam follower link;

(f) means for rollably supporting one end of said cam carrier link;

(g) a second cam follower link having one end pivotally mounted on the packaging machine and the other end pivotally connected to the other end of said cam carrier link; and, (h) means for pivoting said second cam follower link between operative positions for oscillating said cam carrier link and said first cam follower link to pivot the roller carrier plate between operative positions for actuating said filler operating shaft between a lowered position and a raised position.

2. A filler drive and volume adjustment apparatus as defined in claim 1, characterized in that:

(a) said apparatus includes a plurality of filler operating shafts.

3. A filler drive and volume adjustment apparatus as defined in either one of claims 1 or 2, characterized in that said means for pivoting said second cam follower link includes:

(a) power means for pivoting said second cam follower link in one direction; and, (b) return means for pivoting said second cam follower link in the other direction.

4. A filler drive and volume adjustment apparatus as defined in claim 3, characterized in that said return means includes:

(a) a return spring means.

5. A filler drive and volume adjustment apparatus as defined in claim 3, characterized in that said means for rollably supporting one end of said cam carrier link includes:

(a) a block having a slot therein and a roller rollably mounted in said slot and attached to said one end of said cam carrier link.

6. A filler drive and volume adjustment apparatus as defined in claim 5, characterized in that said means for rollably supporting one end of said cam carrier link includes:

(a) means for adjustably supporting said block.

7. A filler drive and volume adjustment apparatus as defined in claim 6, characterized in that said means for adjustably supporting said block includes:

(a) a fixedly mounted guide shaft and a rotatable screw shaft, and means for rotating said screw shaft.

8. A filler drive and volume adjustment apparatus as defined in claim 7, characterized in that said means for rotating said screw shaft includes:

(a) a gear means and an adjustment shaft having one end provided with means for rotating the adjustment shaft.

9. A filler drive and volume adjustment apparatus as defined in claim 8, characterized in that said means for rollably supporting one end of said cam carrier link includes:

(a) indicator means for indicating the volume adjustment created when said adjustment shaft is rotated.

10. A filler drive and volume adjustment apparatus as defined in claim 9, characterized in that said indicator means includes:

(a) a calibrated scale;

(b) a pointer movably mounted beside said calibrated scale; and, (c) means interconnecting said pointer with said block whereby when said block is adjusted to make a volume adjustment, the pointer is moved accordingly along said calibrated scale.

11. A filler drive and volume adjustment apparatus as defined in claim 10, characterized in that said means interconnecting said pointer with said block includes:

(a) a cable means.

12. A filler drive and volume adjustment apparatus as defined in claim 11, characterized in that said cable means includes:

(a) a wire rope attached to said pointer and having one end connected to said block and the other end connected to the packaging machine.

13. A filler drive and volume adjustment apparatus as defined in claim 12, characterized in that:

(a) said other end of said wire rope is connected to the packaging machine by a spring means.

14. A filler drive and volume adjustment apparatus as defined in claim 3, characterized in that said power means includes:

(a) a rotatable cam mounted on a rotatable shaft;

(b) pulley and belt drive means interconnecting said rotatable shaft with the main power drive shaft for the packaging machine; and, (c) a cam follower carried on said second cam follower carrier link and operatively engaged with said rotatable cam.

* * * * *